United States Patent [19]

Weldon

[11] 4,008,898

[45] Feb. 22, 1977

[54] WELL APPARATUS

[75] Inventor: James M. Weldon, Houston, Tex.

[73] Assignee: Cameron Iron Works, Inc., Houston, Tex.

[22] Filed: Nov. 13, 1974

[21] Appl. No.: 523,367

Related U.S. Application Data

[63] Continuation-in-part of Ser. No. 480,754, June 19, 1974, abandoned.

[52] U.S. Cl. ..... 277/116.2; 166/70

[51] Int. Cl.[2] ..... F16J 15/10

[58] Field of Search ..... 277/116.6, DIG. 10, 277/116.8, 114, 110, 116.4, 9.5, 116.2; 166/183, 129; 285/3, 4

[56] References Cited

UNITED STATES PATENTS 909,593 1/1909 Heeter ..... 277/116.6

2,896,724 7/1959 Baker ..... 277/9.5

*Primary Examiner*—Robert I. Smith

*Attorney, Agent, or Firm*—W. F. Hyer; Marvin B. Eickenroht

[57] ABSTRACT

Well apparatus is disclosed in which an inner member is adapted to be sealed with respect to an outer member by means of a seal ring of elastomeric material surrounding the inner member for movement from a first position about a first cylindrical surface in which its outer diameter is spaced from a cylindrical bore in the outer member, and a second position about a second, larger cylindrical surface in which its inner and outer diameters are sealably engaged with said second surface and bore in the outer member, respectively.

22 Claims, 14 Drawing Figures

WELL APPARATUS

This application is a continuation-in-part of copending application, Ser. No. 480,754, filed June 19, 1974, and entitled "Well Apparatus" and now abandoned.

This invention relates to apparatus of the type in which an inner member is to be sealed with respect to an outer member of a well; and, more particularly, to improvements in apparatus of this type in which the inner member is to be lowered into and then sealed with respect to a bore in the outer member by means of a seal ring carried about the inner member. In one of its aspects, it relates to well apparatus having a mechanism for releasing telescopically arranged sleeves for relative vertical movement which is especially useful in causing the seal ring to be sealed against the well bore.

In a typical apparatus of this type, such as that shown in U.S. Pat. No. 3,404,736, a seal assembly is lowered by a running tool into a landed position on an underwater casing hanger for sealing between the casing hanger and the bore of the casing head in which the hanger is supported to close off ports through the hanger after cement returns have been circulated upwardly therethrough. For this purpose, the body of the seal assembly carries a seal ring thereabout for sealably engaging the well bore, and thus, in cooperation with additional seal means carried on the body for sealably engaging the casing hanger, bridging the annular space between them. The outer side of the seal assembly body fits closely within the bore so that, in order to prevent the seal ring from engaging obstructions in the bore, the seal ring is carried in an unexpanded condition with its outer diameter spaced from the well bore, as the seal assembly is lowered into or raised from the bore. Then, when the assembly has been landed, the seal ring is compressed to expand its inner and outer diameters into sealing engagement with the seal assembly body and the bore.

Thus, the seal ring is carried within a recess above an upwardly facing shoulder extending inwardly from the outer side of the assembly body, and beneath a downwardly facing shoulder on the lower end of a sleeve connected to the assembly body for downward movement with respect to it. The sleeve is caused to move downwardly by a force transmitted to it by parts on the tool on which the seal assembly is lowered, and, when so moved, squeezes the seal ring between the shoulders to the extent necessary to expand it outwardly into sealing engagement with the well bore with a pressure adequate to contain the well pressure to be held across the seal assembly. As shown in the aforementioned patent, the sleeve may be so lowered, and then held in lowered position, by means of threads between it and the seal assembly body which are caused to make up by means of rotation transmitted to the sleeve by the running tool.

In order to maintain a seal between the seal assembly body and bore, the seal ring must be compressed with sufficient force to not only expand it outwardly against the bore, but also raise the pressure within it above the pressure to be contained in the bore — i.e., the differential pressure across the seal assembly. The force necessary to compress the seal assembly to this extent may be quite large, and in some cases, larger than can be transmitted to the seal assembly sleeve through the pipe string from which the running tool is suspended, especially when the seal assembly is lowered into the bore of an offshore wellhead a great distance below water level.

An object of this invention is to provide apparatus of this type in which considerably less force is required to move the seal ring into sealing engagement.

Another object is to provide such apparatus in which, as in prior apparatus of this type, the seal ring is protected against damage and/or accidental movement into sealing engagement due to engagement with obstructions within the bore as it is lowered therein.

Yet another object is to provide such apparatus in which the seal ring is also protected against accidental movement into sealing engagement as it is lifted from the well bore.

A further object is to provide such apparatus which is of simple construction, relatively inexpensive to manufacture, and resistant to excessive wear.

Still another object is to provide a seal assembly wherein, as in the prior apparatus of this type, the seal ring is movable into sealing engagement merely in response to downward movement of a sleeve relative to the seal assembly body by manipulation of means on the running tool from which the assembly is supported.

A still further object is to provide well apparatus having a simple mechanism by which such a sleeve may be released for vertical movement with respect to another telescopically arranged sleeve in response to vertical movement of still another part, such as the seal assembly body, about which both sleeves are disposed.

These and other objects are accomplished by well apparatus which comprises, as in prior apparatus of this type, a wellhead or other well member having a vertical cylindrical bore, an inner member or body having a cylindrical surface thereabout which is disposable concentrically within the bore of the outer member, and seal ring of elastomeric material disposed about the cylindrical surface intermediate upwardly and downwardly facing shoulders, and with its outer diameter close to but spaced from the bore of the outer member. In accordance with the illustrated embodiments of the present invention, however, the apparatus also comprises means providing another or second cylindrical surface about the inner member which is of larger diameter than the first cylindrical surface, together with means connecting the second cylindrical surface providing means against vertical movement with respect to the means providing each of the shoulders, whereby the shoulders are close to the ends of the seal ring so as to protect the seal ring against obstructions within the bore as the inner member is lowered therein. More particularly, the connecting means are releasable to permit the both shoulder providing means to move relatively vertically with respect to the second cylindrical surface providing means, so as to stretch the seal ring into a position in which its inner diameter is sealably engaged about the second cylindrical surface and its outer diameter is outwardly of the outer edges of the shoulders for sealably engaging with the bore, and also locate the shoulders in positions in which they are close to the ends of the seal ring, but sufficiently spaced apart from one another that the sealing engagement of the seal ring with the second cylindrical surface and the bore is pressure energized in response to pressure differentials thereacross.

Consequently, the only force required to shift the seal ring into and retain it in sealing engagement with the inner and outer members is that necessary to shift it from its first to its second position — i.e., to cause it to slide over the enlarged second cylindrical surface — because, when so shifted, the seal ring merely responds to well pressure, regardless of its magnitude. This force is, of course, only a fraction of that required to compress the seal ring of the above-described well apparatus into sealing engagement and then maintain it in such engagement, especially when such pressures are of large magnitude, requiring that the seal ring be compressed with a proportional force. Furthermore, since the shoulders are close to its opposite ends, when stretched over the second cylindrical surface, the seal ring is prevented from excessive vertical shifting, in response to pressure differential thereacross, which might otherwise cause it to wear excessively.

In one embodiment of the invention, the means providing the second cylindrical surface is fixed to the inner member, and the means providing a first of the shoulders is releasably connected to the inner member for vertical movement with respect thereto. More particularly, the first shoulder is formed on the lower end of an upper sleeve disposed about the inner member or body for movement downwardly with respect thereto, and the second shoulder is formed on the upper end of a lower sleeve which is releasably connected by shear pins to the second cylindrical surface, so that when the upper sleeve moves downwardly to shift the seal ring onto the second cylindrical surface, the ring bears against the lower sleeve to shear the pins and release it to move downwardly onto a shoulder about the outer surface of the inner member at the lower end of the second cylindrical surface.

In another embodiment of the invention, the means providing the first shoulder is fixed to the inner member, and the means providing the second cylindrical surface is vertically movable with respect to the inner member. More particularly, the first shoulder extends inwardly from the outer side of the inner member at the lower end of the first cylindrical surface, the second cylindrical surface providing means comprises an expander sleeve which is connected to the inner member by means of shear pins, and the second shoulder is provided on the lower end of another sleeve which is releasably connected about the expander sleeve. When the expander sleeve is released to move downwardly over the inner member, the lower end of the seal ring is caused to seat on the first shoulder, so that the expander sleeve moves inside the inner diameter of the seal ring to stretch it into its second position. At the same time, the other sleeve is released from the expander sleeve to permit it to be moved upwardly relatively thereto a distance limited by a downwardly facing shoulder on the expander sleeve to locate the other sleeve in its position close to the upper end of the stretched seal ring.

In the illustrated embodiments of the invention, wherein the inner member is a seal assembly body, the sleeve which is connected to the inner member has parts thereon engageable by parts on a running tool for transmitting force to the sleeve to cause it to be moved downwardly with respect to the body. In the event the seal ring does not hold the required pressure, and it is desired to lift the seal assembly from the bore, the running tool need only be actuated to lift the sleeve, and then reciprocated to cause the seal ring to slip off the enlarged second cylindrical surface and onto the first such surface, prior to lifting from the bore. Since the seal ring in the second embodiment of the invention is stretched to sealing position by a downward movement of the enlarged second cylindrical surface inside its inner diameter, it will also be protected against unintended expansion when the seal assembly is lifted from the bore.

In the second embodiment of the invention, the means for releasably connecting the other sleeve to the expander sleeve preferably comprises a mechanism which includes a groove about the inner member, oppositely facing grooves about the outer and inner diameters of the expander sleeve and other sleeve, respectively, and a plurality of holes through the expander sleeve which connect the groove about it with the groove about the inner member. A detent is radially slidable in each hole, and a split ring is normally circumferentially contracted to a position in which it is disposed partly in the groove of each of the sleeves so as to force the detents inwardly to a position in which their inner ends are within the groove about the body. Thus, when so contracted, the split ring prevents relative vertical sliding between the sleeves, and retains the detents in positions to be forced outwardly by an edge of the groove about the body, in response to relative vertical sliding between the body and expander sleeve, so as to dispose them entirely within said holes and thereby permit relative sliding between the body and the expander sleeve. This outward movement of the detents forces the split rings into a circumferentially expanded position in which it is disposed entirely within the groove about the inner diameter of the other sleeve, so as to permit the relative vertical sliding between the expander sleeve and other sleeve.

Figure 1:
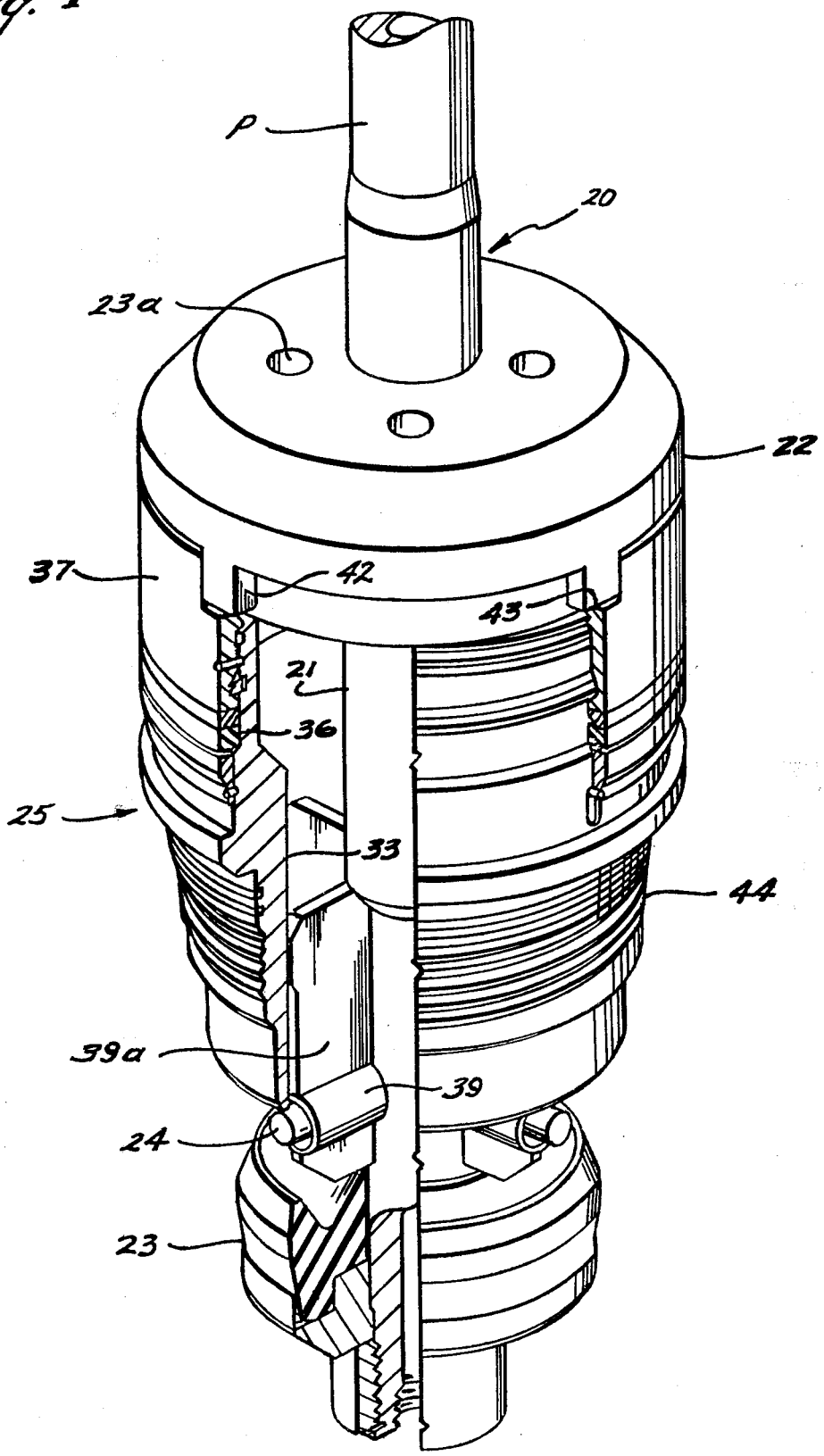
FIG. 1 is an isometric view of a seal assembly constructed in accordance with the first-mentioned embodiment of the present invention and supported from a running tool prior to being lowered into the bore of a casing head, each of the seal assembly and running tool being broken away in part for purposes of illustration.

With reference now to the details of the above-described drawings, the running tool, which is indicated in its entirety by reference character 20, comprises an elongate body 21 having an enlarged head 22 at its upper end and a packer 23 about its lower end. As best shown in FIG. 1, the first seal assembly embodiment, which is designated in its entirety by reference character 25, is disposed about the running tool body beneath the head 22 and supported therefrom by means of latch members 24 extending outwardly beneath its lower end.

Figure 2:
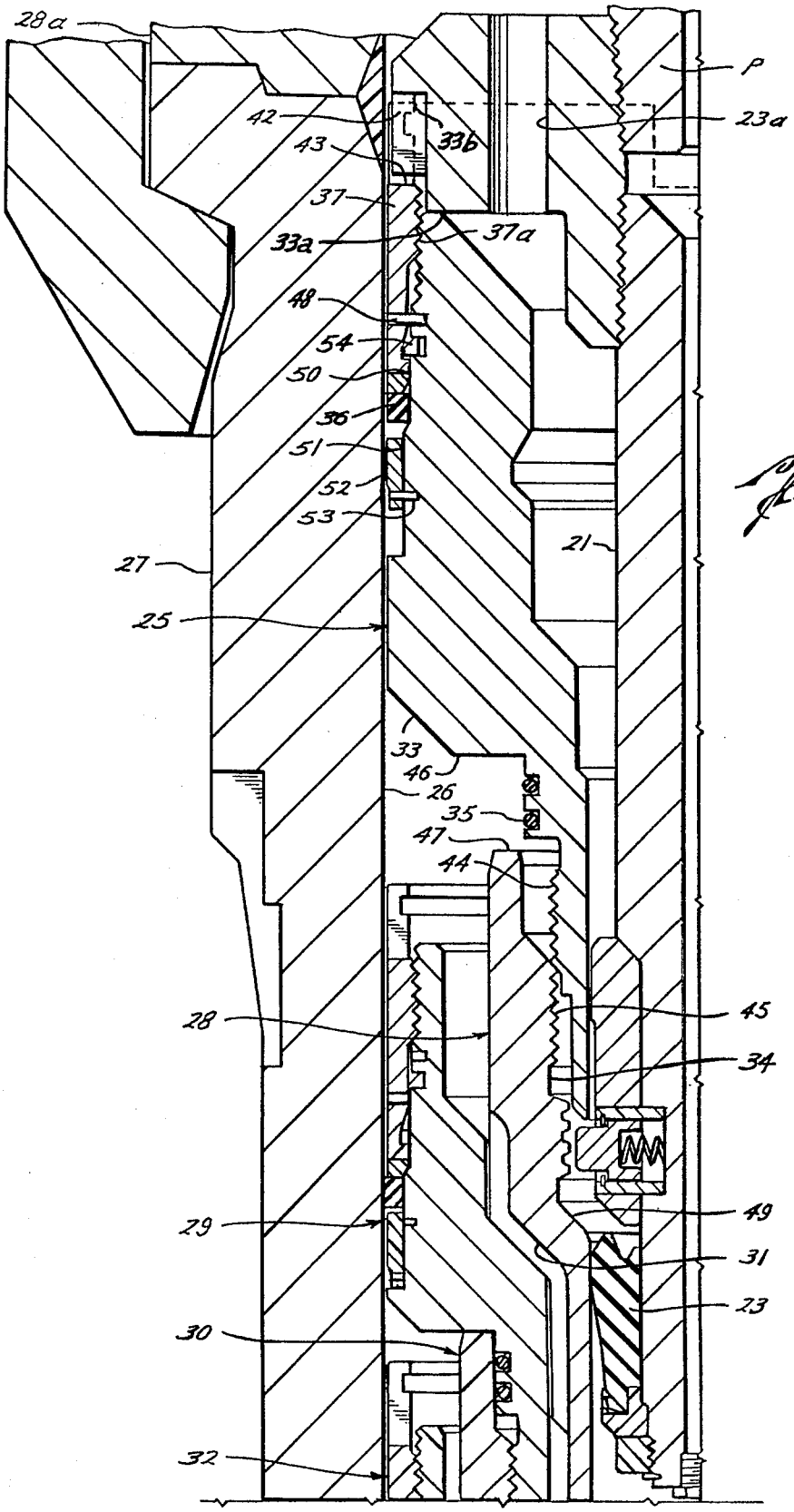
FIG. 2 is a partial vertical sectional view of the seal assembly and running tool during lowering of the seal assembly toward landed position on a casing hanger disposed within the casing head bore.

Running tool body 21 is suspended from a pipe string P, so that, as previously described, and as shown in FIG. 2, it may lower the seal assembly through the bore 26 of a casing head 27 for landing upon and connection to a casing hanger 28 disposed within the bore and suspending a casing string (not shown) therein. As also shown in FIG. 2, the casing head is connected at its upper end to a connector 28*a* or other wellhead portion, which is in turn connected with a blowout preventer stack (not shown) having a bore which provides an upward continuation of bore 26 through the casing head. Head 22 of the tool body fits closely within the bore, and a series of ports 23*a* extend through the head to facilitate its vertical movement in the bore.

Figure 6:
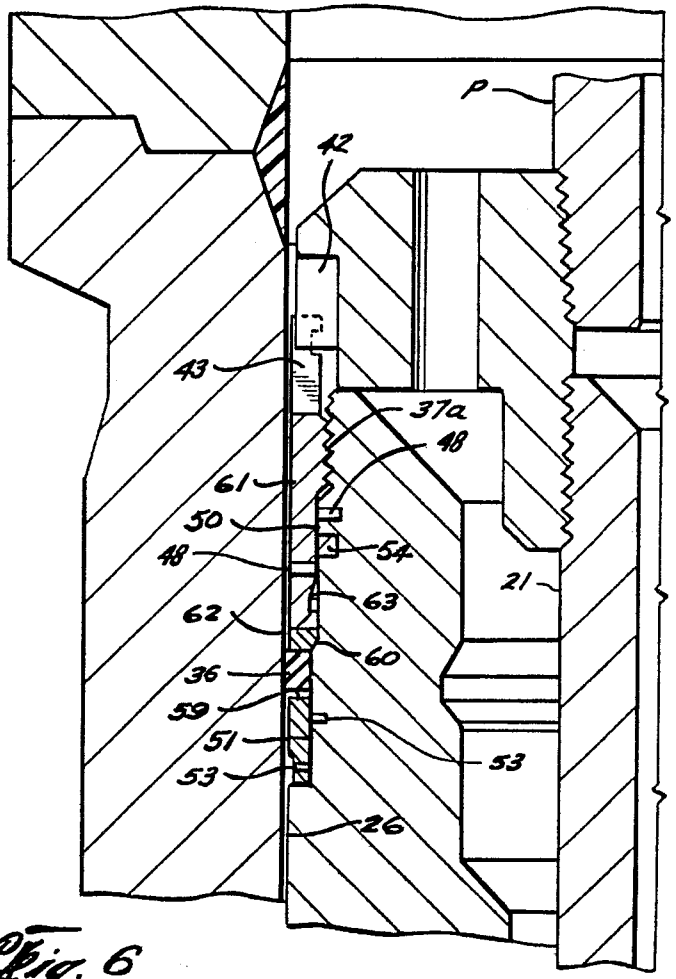
FIG. 6 is a view similar to FIG. 5, but upon further rotation of the running tool to further lower the upper sleeve, release the lower sleeve, and lower the seal ring onto the enlarged cylindrical surface for sealing against the bore of the casing head.

As will be described below, after cement returns have been circulated upwardly through the annular space between the casing hanger and well bore, and the seal assembly has been lowered into the bore to connect to and land on casing hanger 28, a seal ring 36 carried by the assembly is shifted into sealing engagement with the casing head bore, as shown in FIG. 6, so as to close off such space. As shown in FIG. 2, casing hanger 28 is landed upon another seal assembly 29, which in turn is landed upon and connected to another casing hanger 30 from which another casing string (not shown) is suspended and cemented within the well bore. The outer side of casing hanger 28 is provided with a plurality of recesses 31 thereabout which, when seated on seal assembly 29, provides ports for connecting the annular space above seal assembly 29 with the annular space between the casing strings suspended from hangers 28 and 30.

The casing hanger 30 is also landed upon a seal assembly 32 connected to the landed upon still another casing hanger (not shown) for suspending a still further casing string within the bore. This invention contemplates that each such additional seal assembly may be connected, landed and activated in a manner to be described in connection with the seal assembly 25. It is also contemplated that a lesser or greater number of casing hangers and seal assemblies may be landed within the well bore, and that, in accordance with the broader aspects of the invention, each of the casing hanger and seal assembly may be other members disposable within a well bore.

In any event, and as best shown in FIG. 2, the seal assembly 25 includes a body 33 having an enlarged upper end having an outer cylindrical side forming a substantial continuation of the upper enlarged end of the running tool body, and a reduced lower end adapted for connection with and landing on casing hanger 28 within an enlarged upper portion 34 of its bore. As shown, the bores through the telescopically arranged lower end of the seal assembly and upper end of the casing hanger are axially aligned and of substantially the same diameter. When the seal assembly is landed on the casing hanger, seal rings 35 about the upper end of its reduced lower end fit within the seal against the upper enlarged portion of the bore through the casing hanger.

As shown, seal ring 36 is beneath a sleeve 37 of the seal assembly which is threadedly connected at 37*a* to body 33 thereof. Thus, as will be described below, sleeve 37 may be rotated to move it downwardly relatively to the body 33 so as to move the seal ring into sealing engagement against the casing head bore. For reasons to be described, one or more shear pins 48 connect the portions to cause portion 33 to rotate with portion 37 until sufficient torque is applied to portion 37 to shear the pin.

Figure 4:
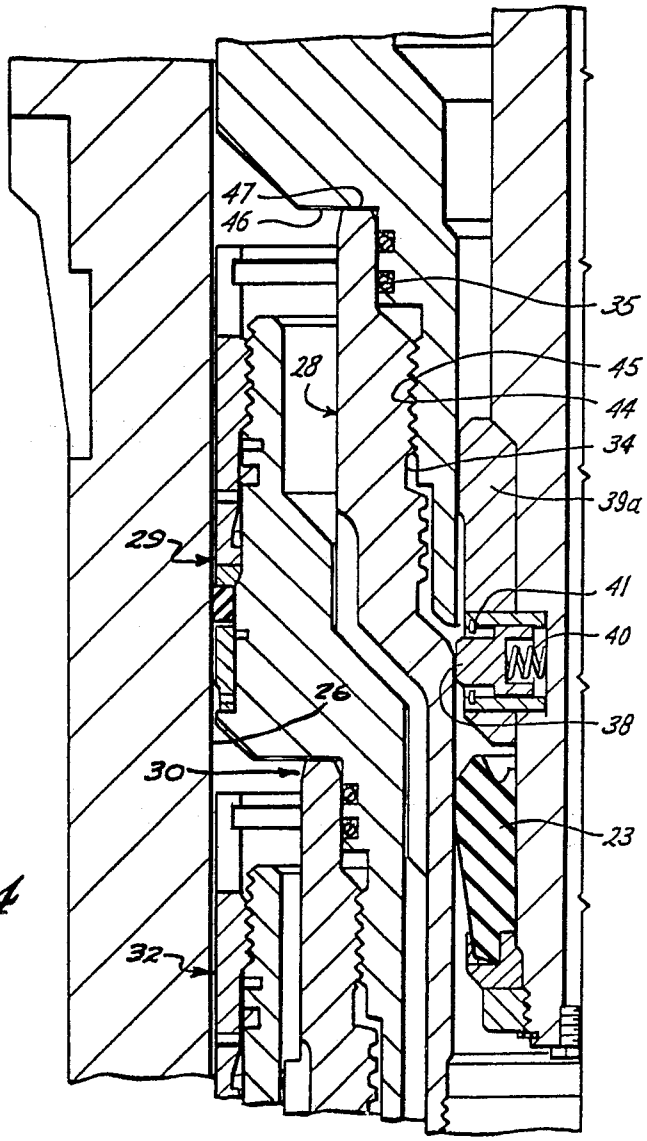
FIG. 4 is another partial sectional view similar to FIG. 3, but upon still further lowering of the seal assembly into connected and landed position on the casing hanger.
Figure 3:
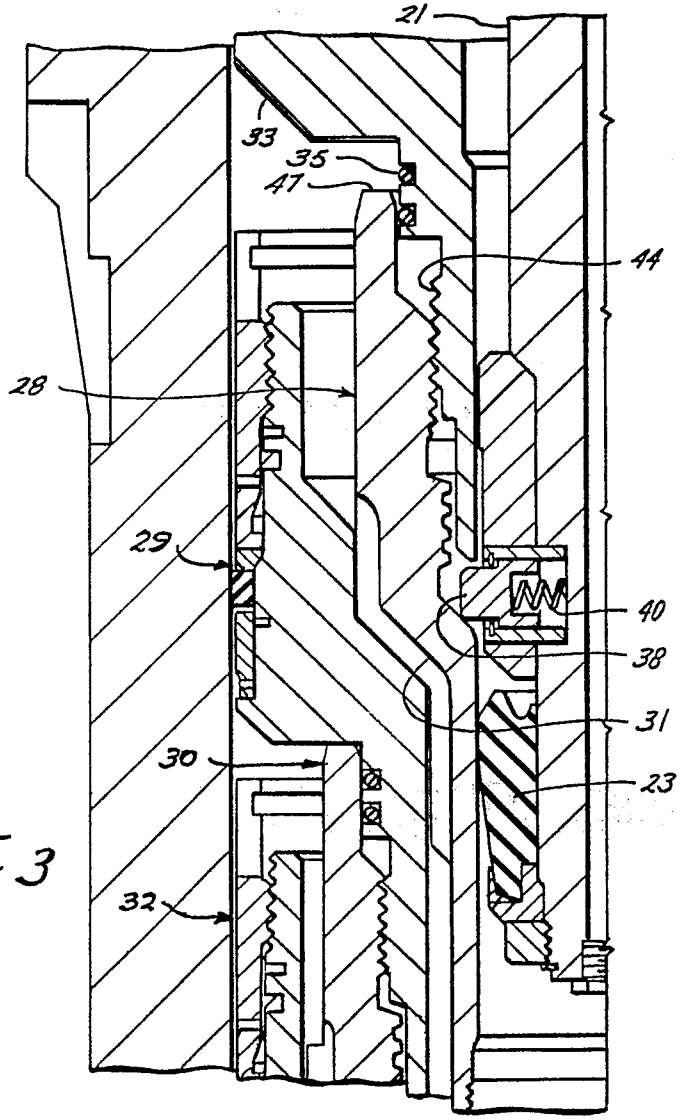
FIG. 3 is a partial sectional view of the lower end of the seal assembly and the casing hanger upon further lowering of the seal assembly and running tool.

Each of the latch members 24 comprises a pin disposed within a sleeve 39, which is carried on a rib 39*a* extending lengthwise of running tool body, for sliding radially between an extended position, as shown in FIGS. 1, 2 and 3, and a retracted position, as shown in FIG. 4. When extended, the outer ends 38 of the pins project beyond the adjacent outer ends of ribs 39*a*, which fit closely within the bore of the seal assembly body, and when retracted, the outer ends of the pins are substantially flush with the outer ends of the ribs so as to permit them to move vertically within the bore of the seal assembly. The pins are normally urged to extended positions by means of coil springs 40 disposed within the sleeves, and are located in extended positions by means of snap rings 41.

The seal assembly is assembled on the running tool by movement of its main body portion 33 upwardly over the lower end of the running tool until the shoulder formed by the lower end of the main body portion is disposed above the upper shoulders of the latch members 24, so as to permit the latch members to be urged outwardly to extended positions for supporting the seal assembly for lowering therewith. Of course, during movement of seal assembly body portion 33 upwardly over the lower end of the tool body, its bore above its lower end will force latch members inwardly to retracted positions. With the seal assembly so supported on the latch members, a shoulder 33*a* on the lower side of the enlarged upper end of the running tool body is spaced a short distance above the upper end of body portion 33, and a shoulder 33*b* about the outer side of the upper end of the tool is spaced a somewhat greater distance above the upper end of sleeve 37. Although the lower ends of lugs 42 about the outer side of the enlarged head of the tool are also spaced the somewhat greater distance above the lower ends of similarly shaped recesses 43 about the upper end of sleeve 37 of the seal assembly, they are nevertheless disposed between the sides of the recesses to enable force to be transmitted from the running tool to the seal assembly for the purposes and in a manner to be described.

The lower end of the main body portion of the seal assembly has external threads 44 adapted to be connected with internal threads 45 on the enlarged bore in the upper end of the casing hanger. During making up of threads 44 with threads 45, a shoulder 46 on the bottom side of the upper enlarged end of the seal assembly is adapted to land on an upwardly facing shoulder 47 formed on the upper end of the casing hanger. Upon rotation of the running tool, lugs 42 thereon engage with the sides of recesses 43 in sleeve 37 of the seal assembly, and shear pins 48 rotate body 33 with sleeve 37 so as to make up threads 44 with threads 45. Then, when shoulders 46 and 47 are engaged, continued rotation of the running tool shears pins 48 and thus moves sleeve 37 downwardly relative to body 33 for moving seal ring 36 into sealing position.

When the lower ends of threads 44 have been lowered onto the upper end of threads 45, and the running tool is rotated so as to begin making up threads 44 with threads 45 in order to connect the seal assembly to the casing hanger, the downwardly facing shoulder on the bottom surfaces of the latch members engage an upwardly facing shoulder 49 on the bore of the casing hanger. As shown, this shoulder tapers downwardly and inwardly, and the outer end of each latch member pin is beveled, so that further making up of the threads 44 and 45 causes the shoulders formed on the lower surfaces of the latch members to slide downwardly over the tapered shoulder 49, and thus be urged inwardly toward retracted position. At some point intermediate the positions shown in FIGS. 3 and 4, seal rings 35 will move into sealing engagement with the enlarged bore in the upper end of the casing hanger, and the latch members will move to fully retracted positions, such that still further making up of threads 44 and 45 will cause the flat outer ends 38 of the latch members to slide downwardly within the reduced bore of the casing hanger beneath shoulder 49 until shoulder 46 lands on shoulder 47, as shown in FIG. 4.

At this time, the downwardly facing shoulder on the lower end of the seal assembly will be spaced above the shoulder 49 on the casing hanger a vertical distance less than that between the shoulders formed on the top and bottom surfaces of the latch members. Consequently, upon lifting of the running tool body, the latch members are unable to move back into the space between the shoulders on the seal assembly and casing hanger, and are thus held in retracted positions as they move upwardly within the bore through the body of the seal assembly, thereby permitting the tool to be lifted from the seal assembly and thus removed from the bore.

Figure 5:
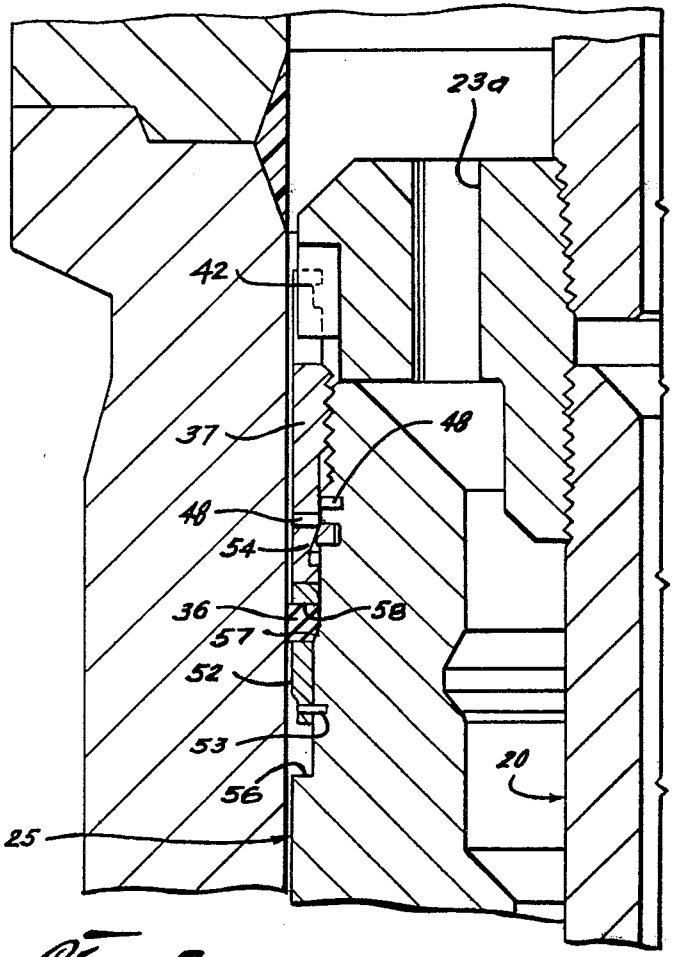
FIG. 5 is a partial sectional view of the upper end of the running tool and seal assembly, following connection and landing of the seal assembly, and upon initial rotation of the running tool to lower the upper sleeve and thus urge the seal ring against the lower sleeve.

However, before it is so lifted from the seal assembly, the running tool is further manipulated in order to move the seal ring 36 into sealing engagement with the bore. For this purpose, the running tool continues to be rotated and, since shoulder 46 is landed on shoulder 47, this shears the pins 48, as shown in FIG. 5, and thus causes the threads on sleeve 37 to move downwardly over the threads on body portion 33. When this occurs, the lower end of sleeve 37 forces seal ring 36 downwardly from its running-in position in which its outer diameter is spaced from bore 26 to its activated position in which its outer diameter is sealably engaged with the bore.

As shown, seal ring 36 is received within a recess above a shoulder 56 which extends inwardly from the enlarged upper end of seal assembly body 33. The inner wall of the recess includes a cylindrical surface 50 about body portion 33 beneath threads 37*a*, an enlarged cylindrical surface 51 beneath surface 50, and a conical surface 57 connecting the lower end of surface 50 with the upper end of surface 51. Each of cylindrical surfaces 50 and 51 is concentric with the outer side of the enlarged upper end of body 33 below shoulder 56.

In the raised position of sleeve 47, prior to shearing of the pins 48, a shoulder 58 on its lower end is above conical surface 57 to permit seal ring 36 to surround surface 50 in a relaxed state. More particularly, with the lower end of the seal ring resting on the upper end of the conical surface, shoulder 58 is close to the upper end of the seal ring to prevent the entrance of obstructions therebetween. At this time, a sleeve 52 having an outer diameter equal to that of sleeve 37 closely surrounds and is connected to the surface 51 by one or more shear pins 53 to dispose a shoulder 59 at its upper end at substantially the lower end of conical surface 57, and thus close to the lower end of seal ring 36 to prevent the entrance of obstructions therebetween, and its lower end above shoulder 56. As shown, in its relaxed state, the seal ring is of such thickness that its inner diameter fits closely about surfaces 50 and its outer diameter is spaced from the bore just inwardly of the aligned cylindrical outer edges of shoulders 58 and 59.

As indicated in FIG. 5, when the running tool is first rotated to shear pins 48 and thereby lower sleeve 37, shoulder 58 compresses the seal ring against conical surface 57, causing its lower end to expand outwardly against bore 26 and bear against shoulder 59 on the upper end of sleeve 52. Continued lowering of the sleeve 37 will transmit a force downwardly to sleeve 52 sufficient to shear pins 53, thereby releasing sleeve 52 for downward movement onto shoulder 56. This permits the continued downward movement of sleeve 37 to force the entire seal ring downwardly over conical surface 57 and onto cylindrical surface 51. As the seal ring is so moved, a conical surface 60 on the inner side of sleeve 37 engages surface 57 to stop further downward movement of the sleeve 37. Although sleeve 37 has moved a fairly substantial distance downwardly, as indicated by a comparison of FIGS. 2 and 6, it nevertheless maintains rotative engagement with the running tool body through lugs 42 fitting within recesses 43.

When seal ring 36 is stretched over surface 51, its inner diameter is sealably engaged therewith, and its outer diameter is sealably engaged with bore 26. As known in the art, this sealing engagement with the oppositely facing cylindrical surfaces is pressure energized and thus responsive to pressure differential thereacross, regardless of magnitude, without the necessity of axial compression. Thus, the only axial force required in activating the seal is that necessary to shear pins 48 and 53 and move the seal ring onto surface 51.

As shown in FIG. 6, sleeve 52 is of such length that when it is landed on shoulder 56, a shoulder 59 on its upper end is spaced from shoulder 58 a distance slightly greater than the end-to-end length of the stretched seal ring 36. Consequently, assuming that the predominant pressure is beneath the seal assembly so as to shift the seal ring upwardly against shoulder 58, there will be a slight gap between shoulder 59 and the lower end of the seal ring. Obviously, however, upon a reversal in the pressure differential, the seal ring shifts downwardly against shoulder 59 to leave a gap between its upper end and shoulder 58. In any event, however, the gap is preferably just large enough to insure that fluid pressure is effective across the entire face of the end of the seal ring in order to maintain its pressure energized seal between body 33 and bore 26. Consequently, there is a minimum of wear on the seal ring because of vertical reciprocation in its sealing position.

Sleeve 37 is comprised of two vertically disposed, independently rotatable parts, an upper ring 61 having threads 37*a* formed thereon, and a ring 62 having the shoulder 58 formed thereon. Since shoulder 58 does not rotate with ring 61, it does not rub over and thus wear the upper end of seal ring 36.

The sealing engagement of seal ring 36 with bore 26 and seal assembly body portion 33 may be tested by means of test pressure admitted to the annular space between the pipe string P and the bore 26 of the wellhead intermediate the seal assembly and rams on the blowout preventer stack which are closed on the pipe string. In this connection, it will be noted that packer 23 carried about the lower end of the running tool body 21 sealably engages the reduced bore through casing hanger 28, and that seal rings 35 on seal assembly body portion 33 sealably engage casing hanger 28.

If seal ring 36 holds test pressure, the running tool need only be lifted from the well bore as previously described. However, in the event seal ring 36 does not hold test pressure, the running tool may be rotated in the opposite direction to raise upper ring of sleeve 37 to its original position. The inner side of ring 61 has a recess 63 with a horizontally extending lower end which is so located as to receive a latch in the form of an outwardly biased split ring 54 when the ring 61 is moved upwardly just above its original upper position so as to prevent its further upward movement. A set screw 64 (FIG. 7) permits the split ring to be forced inwardly into its groove 65 for disassembly purposes, if and when the seal assembly is raised to surface level.

Figure 7:
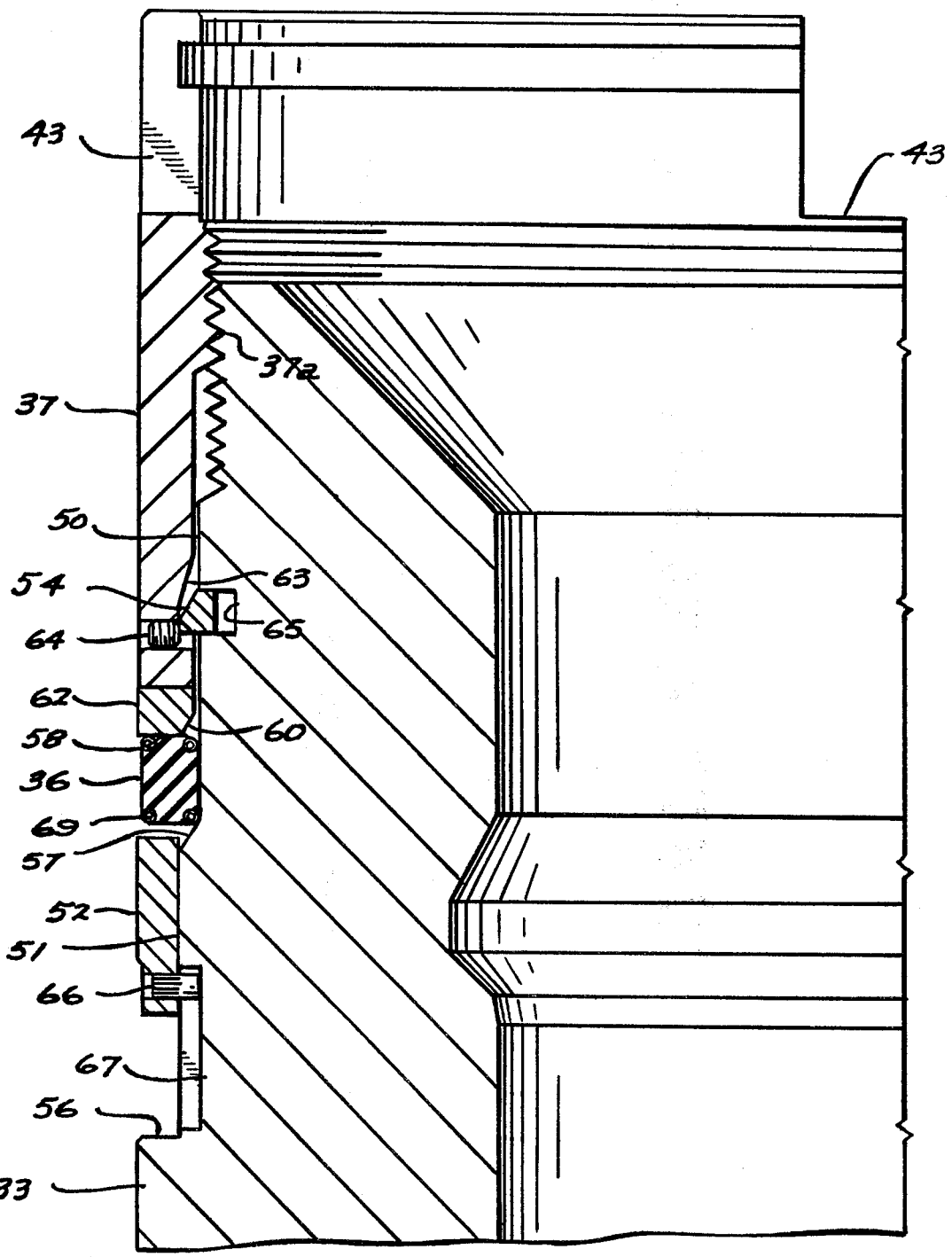
FIG. 7 is an enlarged partial sectional view of the seal assembly, prior to connection with the running tool.

With ring 61 held against further upward movement, continued rotation of the running tool will back threads 44 out of threads 45 to release the seal assembly from the casing hanger. As this occurs, latch members 24 will move back into extended positions beneath the lower end of the seal assembly for lifting the assembly from the well bore with the running tool. The stretched seal ring 36 may be caused to move back onto surface 50, and thus out of the way of obstructions within the well bore, and to lift ring 62 to a position beneath ring 61, by reciprocating the running tool and seal assembly after they are lifted from the casing hanger. As shown in FIG. 7, upward movement of sleeve 52 is limited to substantially its original upper position by means of one or more pins 66 on the sleeve which slide in slots 67 formed in enlarged surface 51. The upper ends of the slots are so located as to prevent shoulder 59 from compressing the seal ring during reciprocation of the seal assembly. Coil springs 69 are embedded in the four corners of the seal ring to prevent their extrusion.

Figure 8:
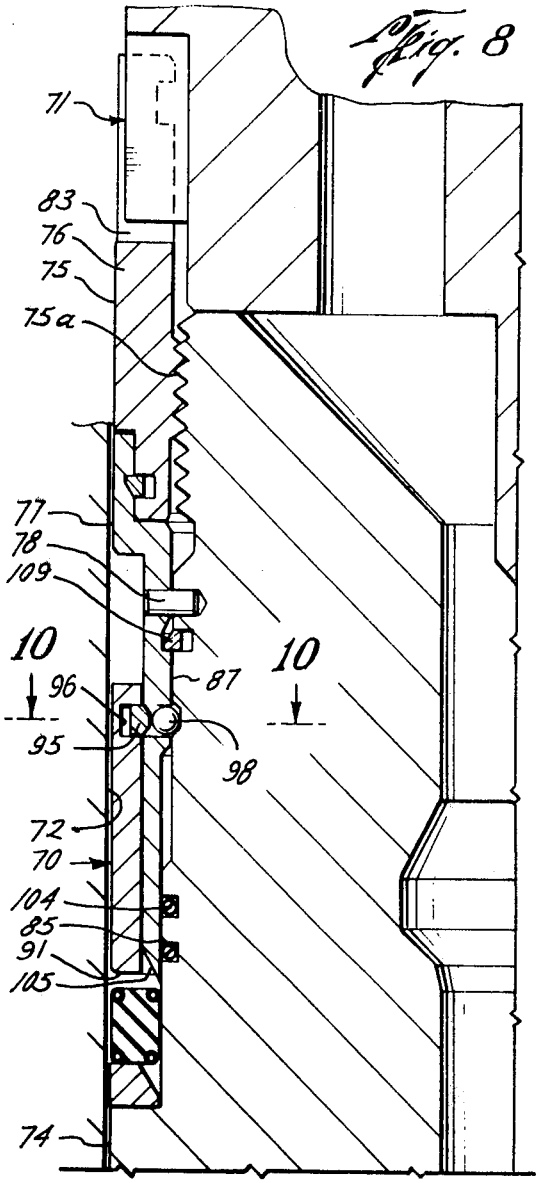
FIG. 8 is a vertical sectional view of part of a seal assembly constructed in accordance with the second mentioned embodiment of the invention, and as seen along broken line 8—8 of FIG. 10, the seal ring being shown prior to being stretched into sealing engagement with the bore.
Figure 9:
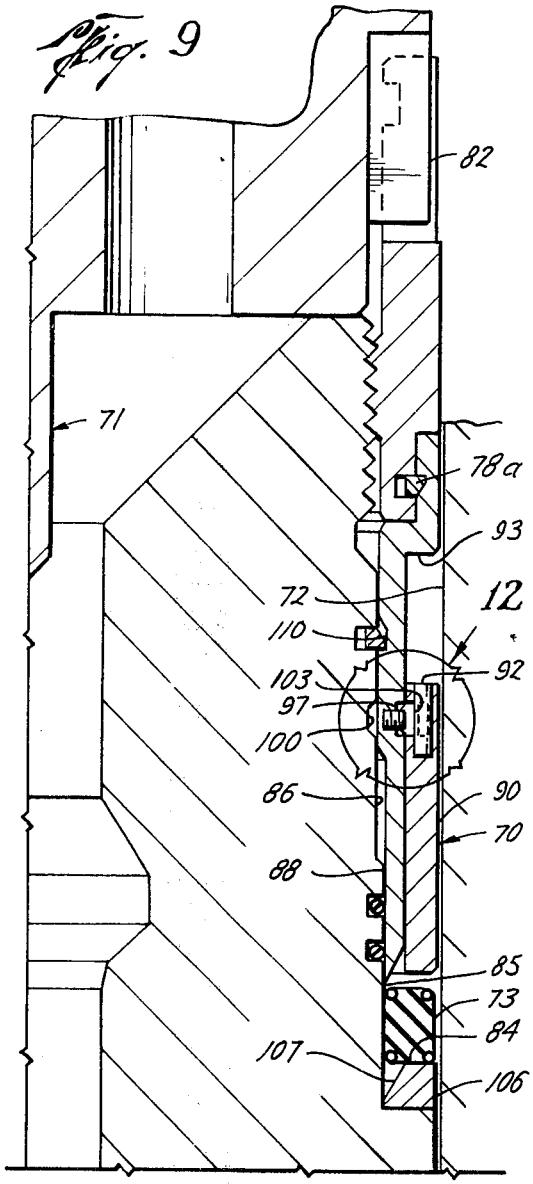
FIG. 9 is another sectional view of the seal assembly of FIG. 8, as seen along broken line 9—9 of FIG. 10, and also showing the seal ring prior to being stretched into sealing engagement.
Figure 8A:
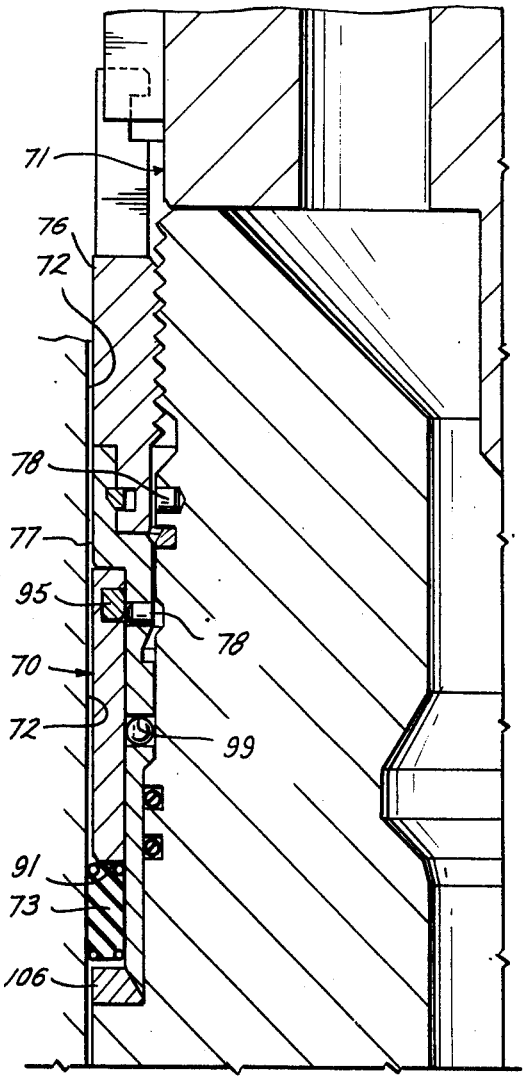
FIGS. 8A and 9A are views similar to FIGS. 8 and 9, respectively, but showing the seal ring stretched into sealing engagement with the well bore.
Figure 9A:
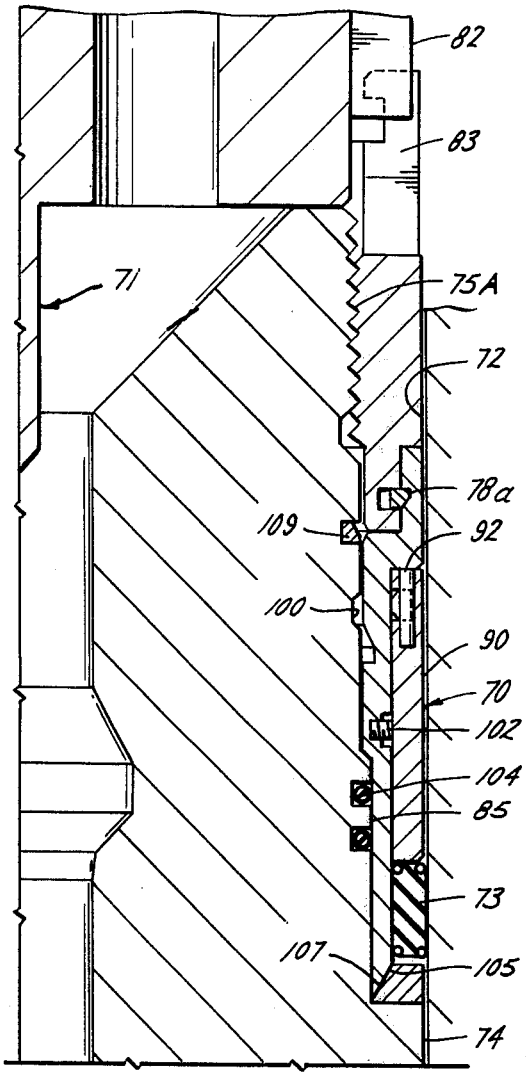

The second seal assembly embodiment, which is indicated in its entirety by reference character 70, is shown in FIGS. 8, 8A, 9 and 9A to be disposed about and supported from a running tool 71 for lowering therewith into a bore 72 of a casing head. The running tool 71 is identical to the running tool described in connection with the first embodiment, with respect to both its construction and manipulation in landing and connecting the seal assembly to a casing hanger (not shown) disposed within bore 72, and then causing a seal ring 73 carried thereby to be stretched from a non-sealing running in position (FIGS. 8 and 9) into sealing engagement with the bore (FIGS. 8A and 9A).

As in the case of the first embodiment, the seal assembly 70 includes a body 74 having an enlarged upper end whose outer side provides an outer cylindrical surface forming a substantial vertical continuation of the upper enlarged end of the body of the running tool 71. As was also the case of the body of the first embodiment, body 74 is tubular and has means (not shown) at its lower end for connecting to the casing hanger from which a casing is suspended within the well bore. Seal ring 73 is disposed about body 74 beneath a sleeve 75 threadedly connected at 75*a* to the body, and thus in position to be moved into sealing engagement with bore 72 as the sleeve is moved downwardly relatively to body 74, from the position shown in FIGS. 8 and 9 to the position shown in FIGS. 8A and 9A.

In this second embodiment of the invention, sleeve 75 includes an upper section 76 having a lower end telescopically received within a lower section 77. The lower section is supported from the upper section by means of a snap ring 78*a* so as to move vertically therewith, while permitting the upper section to be rotated with respect to the lower section. As shown, threads 75*a* connecting sleeve 75 with body 74 are formed on upper section 76, and the lower section is releasably connected to the body by one or more shear pins 78. Thus, as will be described, body 74 may be rotated initially with sleeve 75 in order to connect the seal assembly with the casing hanger. As in the case of the previously described running tool and seal assembly, lugs 82 carried about the enlarged upper end of the running tool are disposed within similarly shaped recesses 83 in the upper end of sleeve section 76, whereby rotation of the running tool may be transmitted to the seal assembly.

As was also the case in the first embodiment, the lower end (not shown) of body 74 of seal assembly 70 is provided with external threads for connection with internal threads on an enlarged upper bore on the upper end of the casing hanger. When these threads are made up to land a shoulder on the seal assembly on a shoulder on the casing hanger, continued rotation of the running tool will shear pins 78 and thus cause sleeve 75 to move downwardly relative to body 74, upon continued rotation of the running tool, so as to move seal ring 73 to its sealing position.

The seal ring 73 is seated on a shoulder 84 which extends inwardly from the cylindrical surface about the outer side of the enlarged upper end of body 74 and is close about a cylindrical surface 85 on the body extending upwardly from shoulder 84. A somewhat reduced diameter cylindrical surface 86 extends upwardly from the upper end of surface 85 to the lower end of threads 75*a*, and the lower section 77 of sleeve 75 has cylindrical surfaces 87 and 88 on its inner side which are vertically slidable over cylindrical body surfaces 86 and 85, respectively, all of which are concentric with the cylindrical surface on the outer sides of the body 74 and sleeve 75.

When sleeve 75 is in its upper position and connected to body 74 by means of shear pin 78, as shown in FIGS. 8 and 9, the lower end of sleeve section 77 is disposed above seal ring 73, which is in a relatively relaxed state, with its inner diameter close about the surface 85 and its outer diameter spaced from bore 72 and substantially vertically aligned with the cylindrical surface on the outer side of body 74. In running-in position of the seal assembly, another sleeve 90, which is releasably connected about the sleeve section 77 in a manner to be described, is disposed with a shoulder 91 on its lower end substantially horizontally aligned with the lower end of sleeve section 77, and thus close to the upper end of seal ring 73 to prevent the entry of obstructions therebetween. The outer diameter of the outer sleeve 90 is substantially the same as the outer diameter of the enlarged upper end of the sleeve section 77 and the outer cylindrical surface of the outer side of body 74, and thus in substantial vertical alignment with the outer diameter of the relaxed seal ring 73.

Following landing of the seal assembly on the casing hanger, continued rotation of running tool 71 shears pins 78 to move the sleeve 75 downwardly with respect to body 74. As will be described, this downward movement of sleeve 75 automatically releases sleeve 90 from connection thereto, whereby sleeve section 77 is free to move downwardly with respect to sleeve 90 and thus within the inner diameter of seal ring 73 so as to stretch it outwardly to its sealing position, as shown in FIGS. 8A and 9A. A shoulder 92 on the upper end of sleeve 90 is so spaced from a shoulder 93 on the lower end of the upper enlarged portion of sleeve section 77 that, during this downward movement of sleeve section 77, sleeve 90 is not forced downwardly against seal ring 73, but instead is free to move upwardly relatively to sleeve section 77, until the cylindrical surface on the outer side of such section has moved downwardly within the inner diameter of seal ring 73. However, this relative upward movement is limited by the engagement of shoulder 92 with shoulder 93 so that, in any event, and as shown in FIGS. 8A and 9A, shoulder 91 on the lower end of sleeve 90 is close to the upper end of seal ring 73 so as to prevent excessive reciprocation thereof, but sufficiently spaced from shoulder 84 that, as described in connection with the first embodiment, the sealing engagement of ring 73 with sleeve section 77 and casing head bore 72 is pressure energized in response to pressure differentials thereacross.

Figure 11:
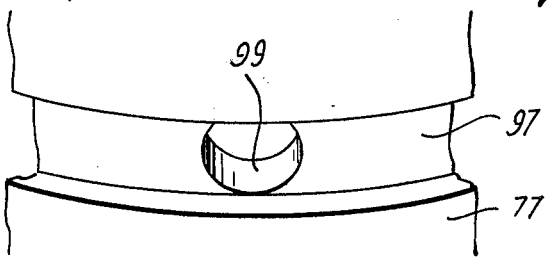
FIG. 11 is an enlarged isometric view of a portion of the outer side of the expander sleeve of the seal assembly.

The means by which sleeve 90 is releasably connected to sleeve 77 comprises a snap ring 95 which, when circumferentially contracted, as shown in FIGS. 8 and 9, is received within oppositely facing grooves 96 and 97 in the inner diameter of sleeve 90 and the outer diameter of sleeve section 77, respectively, so as to prevent them from moving vertically relative to one another. When so contracted, the inner diameter of the snap ring bears against a series of ball detents 98 received within circumferentially spaced-apart holes 99 (see FIG. 11) extending radially through sleeve portion 77 and projecting on their inner sides into a groove 100 about outer cylindrical surface 86 of body 74 so as to bridge the separation between body 74 and sleeve section 77.

However, the depth of groove 100 is less than half the diameter of each ball detent, so that, upon shearing of pins 78, and downward movement of sleeve section 77, the lower edge of groove 100 will force the ball detents radially outwardly. More particularly, the depth of groove 100 is substantially equal to the depth of groove 97 about the outer diameter of sleeve section 77, so that when the sleeve section has been moved downwardly far enough to force the ball detents entirely within holes 99, the snap ring 95 has been radially circumferentially expanded so as to dispose it entirely within the groove 96. Thus, sleeve 77 is free to continue to move downwardly with respect to the sleeve 90 for the purposes previously described.

Figure 10:
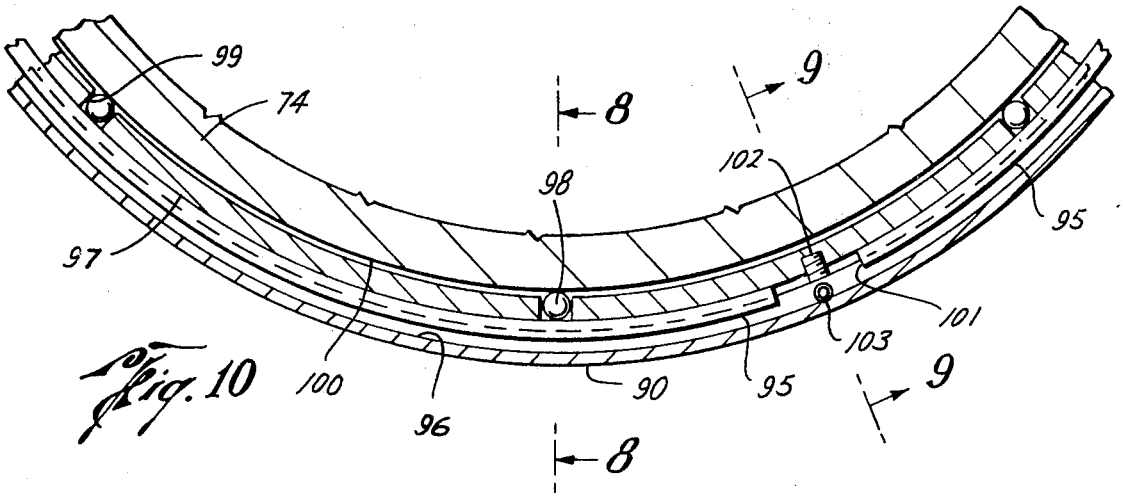
FIG. 10 is a horizontal sectional view of the seal assembly, as seen along broken line 10—10 of FIG. 8.
Figure 12:
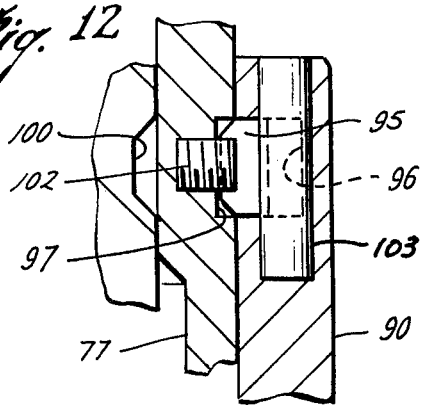
FIG. 12 is an enlargement of the encircled portion of the vertical sectional view of FIG. 9 indicated by reference character 12 of FIG. 9.

This releasable connecting mechanism also includes means for insuring that ball detents 98 are never permitted to be opposite a discontinuity 101 (FIG. 10) in snap ring 95. For this purpose, a set screw 102 is connected to the outer side of sleeve section 77 within groove 97, in a position to engage opposite sides of the snap ring discontinuity and thus limit its rotational movement with respect to the ball detents. The outer end of the set screw 102 is aligned with the outer diameter of sleeve section 77 so as to avoid interference with sliding of sleeve 90 vertically with respect thereto. A pin 103 is received in aligned holes in the upper end of sleeve 90 to bridge groove 96 about the inner diameter of the sleeve 90, as best shown in FIG. 12. As shown in FIG. 10, pin 103 is disposed between the opposite ends of the discontinuity 101 in the split ring in a position to limit rotation of sleeve 90 relative to the split ring which might otherwise permit balls 98 to be opposite the discontinuity of the split ring.

Seal rings 104 are carried within grooves about cylindrical surface 85 of body 74 for sealably engaging with the inner diameter of the lower end of sleeve section 77. Thus, as will be understood from FIGS. 8A and 9A, these seal rings 104 cooperate with stretched seal ring 73 to form a complete closure between the bore 72 and seal assembly body 74.

The lower end of the sleeve section 77 is provided with a conical surface 105, and a similarly shaped surface 107 is provided on body 74 inwardly and below the shoulder 84 for receiving the lower end of the sleeve when it is moved downwardly within the inner diameter of seal ring 73, as shown in FIGS. 8A and 9A. For machining purposes, the shoulder 84 and conical surface 107 are formed on a separate ring 106.

As in the case of the first embodiment, since the gap provided between either or both of the upper and lower ends of the expanded seal ring 73 and the shoulders 84 and 91 opposite thereto is preferably just large enough to insure that fluid pressure is effective across the entire surface of the end of the seal ring, there is a minimum of wear on the seal ring in the event it reciprocates vertically responsive to pressure differential thereacross. Also, since sleeve section 77 is free to rotate with respect to sleeve section 76 of sleeve 75, and further since sleeve 90 is free to rotate with respect to sleeve section 77, there is no rubbing action against seal ring 73 as sleeve section 77 is moved downwardly within the seal ring in response to rotation of sleeve section 76.

The sealing engagement of seal ring 73 may be tested in the same manner as described with respect to the first embodiment. If it holds test pressure, running tool 71 need only be lifted from the well bore since, as described in connection with the first embodiment, it is unlatched from the seal assembly. However, if the seal ring doesn't hold test pressure, the running tool is rotated in a direction to raise sleeve 75 with respect to body 74, and, as this occurs a split ring 109 carried in a groove in the cylindrical surface 86 about the body will snap outwardly into a groove 110 formed in the inner surface 87 of sleeve section 77. Thus the body is connected to the sleeve for lifting therewith, so as to permit the seal assembly to be raised from the well bore with the running tool.

As shown in the drawings, latch 109 and groove 110 are opposite one another when sleeve section 77 and body 74 are at the same relative level they occupied when connected by the shear pins 78. Thus, sleeve 75 is not only prevented from complete disconnection from body 74, but also lifted to a level which will permit seal ring 73 to be moved downwardly off of its outer diameter onto cylindrical surface 85. For this latter purpose, the running tool may be reciprocated to cause the stretched seal ring, due to its frictional engagement with casing head bore 72, to be swabbed off of sleeve section 77. Since the expanding surface of sleeve section 77 is above the seal ring, there is no danger of the seal ring being moved over it if it should engage with an obstruction in the bore as it is lifted therefrom.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Well apparatus, comprising an outer member having a vertical cylindrical bore therein, an inner member having a first cylindrical surface thereabout which is disposable concentrically within the bore of the outer member, means providing a second cylindrical surface about the inner member which is of larger diameter than the first cylindrical surface, a seal ring of elastomeric material having its inner diameter close about the first cylindrical surface, means providing a first shoulder about the first cylindrical surface, means providing a second shoulder about the second cylindrical surface and facing the first shoulder, the outer edges of said shoulders being substantially vertically aligned with the outer diameter of said seal ring, means connecting said first and second shoulder-providing means against vertical movement with respect to said second surface-providing means to dispose said shoulders close to the ends of said seal ring, said connecting means being releasable to permit relative vertical movement of first and second shoulder-providing means with respect to said second cylindrical surface-providing means, so as to stretch said seal ring into a position in which its inner diameter is sealably engaged about the second cylindrical surface and its outer diameter is outwardly of the outer edges of said shoulders for sealably engaging the bore, and means for limiting said relative movement thereof so as to locate said first and second shoulders in positions in which they are spaced from one another a distance not substantially greater than that of the end-to-end spacing of the stretched seal ring.

2. Apparatus of the character defined in claim 1, wherein said second cylindrical surface-providing means is fixed to said inner member, and said first shoulder-providing means is vertically movable with respect to said inner member.

3. Apparatus of the character defined in claim 1, wherein said first shoulder-providing means is fixed to said inner member, and said second cylindrical surface-providing means is vertically movable with respect to said inner member

4. Apparatus of the character defined in claim 1, wherein the movement limiting means includes a conical surface on the end of the second cylindrical surface-providing means with which a portion of said first shoulder is engageable.

5. Apparatus of the character defined in claim 4, wherein said portion of said first shoulder is a conical surface which conforms to the conical surface on the end of said second cylindrical surface-providing means.

6. Well apparatus, comprising an outer member having a cylindrical bore extending vertically therein, an inner member having a first cylindrical surface thereabout which is lowerable into a landed position concentrically within the bore of the outer member, means providing a second cylindrical surface about the inner member which is concentic with and of larger diameter than the first cylindrical surface, a seal ring of elastomeric material having its inner diameter close about the first cylindrical surface, means providing a first shoulder about the first cylindrical surface, means providing a second shoulder about the second cylindricl surface and facing the first shoulder, the outer edges of said shoulders being concentric with said cylindrical surfaces and substantially vertically aligned with the outer diameter of said seal ring, one of the second cylindrical surface and first shoulder-providing means being fixed against vertical movement with respect to said inner member, means connecting the other of the second cylindrical surface and first shoulder-providing means to the inner member, means connecting the second shoulder-providing means to the second cylindrical surface-providing means, so as to locate said shoulders close to the ends of said seal ring, each of said connecting means being releasable, to permit the other of the first shoulder and second cylindrical surface-providing means and the second shoulder-providing means to be moved relatively vertically with respect to said inner member and said second cylindrical surface-providing means, respectively, so as to stretch said seal ring into a position in which its inner diameter is sealably engaged about the second cylindrical surface and its outer diameter is outwardly of said edges for sealably engaging the bore, and means for limiting the relative vertical movement of said other of the first shoulder and second cylindrical surface-providing means and the second shoulder-providing means with respect to said inner member and said second cylindrical surface-providing means so as to locate said first and second shoulders in positions in which they are spaced from one another a distance not substantially greater than that of the end-to-end spacing of the stretched seal ring.

7. Apparatus of the character defined in claim 6, wherein said first shoulder-providing means comprises a sleeve releasably connected to the first cylindrical surface of the inner member for downward movement therealong.

8. Apparatus of the character defined in claim 6, wherein said second cylindrical surface-providing means comprises a sleeve releasably connected to the first cylindrical surface of the inner member for vertical movement therealong.

9. Apparatus of the character defined in claim 6, including means for preventing return movement of the other of the second cylindrical surface and first shoulder-providing means substantially beyond the position from which it is moved.

10. Apparatus of the character defined in claim 6, wherein the movement limiting means includes a conical surface on the end of the second cylindrical surface-providing means with which a portion of said first shoulder is engageable.

11. Apparatus of the character defined in claim 6, wherein said portion of said first shoulder is a conical surface which conforms to the conical surface on the end of said second cylindrical surface-providing means.

12. A seal assembly, comprising a body adapted to be lowered into a landed position within the bore of a well member, said body having an outer cylindrical side adapted to fit closely within the bore, a shoulder extending inwardly from its outer side, a lower cylindrical surface extending above the shoulder, and a reduced upper cylindrical surface extending above the lower cylindrical surface, both of said cylindrical surfaces being concentric with the outer side of said body, a seal ring of elastomeric material having an inner diameter fitting closely about the upper cylindrical surface, an upper sleeve surrounding the body above the upper cylindrical surface, means connecting the upper sleeve to the body with a shoulder on its lower end close to the upper end of the seal ring, a lower sleeve surrounding the lower cylindrical surface, means connecting the lower sleeve to the body with a shoulder on its upper end close to the lower end of the seal ring, said sleeves having outer cylindrical surfaces adjacent said shoulders which are substantially aligned with the outer side of said body and which extend outwardly at least as far as the outer diameter of the seal ring, the means connecting said upper sleeve to said body being releasable to permit said upper sleeve to move downwardly, in response to downward force thereon, to cause its shoulder to force the seal ring downwardly against the shoulder on said lower sleeve, and the means connecting the lower sleeve to the body being releasable to permit said lower sleeve to move downwardly onto said shoulder on the body, so that, in response to continued downward movement of the upper sleeve, said seal ring is forced downwardly over the lower cylindrical surface, and thereby stretched into a position in which its inner diameter sealably engages said lower cylindrical surface and its outer diameter protrudes from the cylindrical surfaces about the outer sides of said sleeves for sealably engaging the bore, and means on the body engageable with a portion of the shoulder on the upper sleeve to limit its downward movement, when said upper sleeve has been moved downwardly to move said seal ring to sealing position, and said lower sleeve has moved downwardly onto said shoulder on the body, for locating the shoulders on said sleeves in positions in which they are spaced from one another a distance not substantially greater than that of the end-to-end spacing of the stretched seal ring.

13. A seal assembly of the character defined in claim 12, wherein the means on the body engageable with a portion of the shoulder on the upper sleeve includes a conical surface on the upper end of the lower cylindrical surface.

14. A seal assembly of the character defined in claim 13, wherein the portion of said shoulder on the upper sleeve is a conical surface which conforms to the conical surface on the upper end of the lower cylindrical surface.

15. A seal assembly of the character defined in claim 12, including latch means on the body engageable with the upper sleeve to limit upward movement of the upper sleeve substantially beyond the position from which it is moved downwardly.

16. A seal assembly of the character defined in claim 15, including means for limiting upward movement of the lower sleeve substantially beyond the position it occupies when releasably connected to said body.

17. A seal assembly of the character defined in claim 12, wherein the upper sleeve includes a lower portion on which its shoulder is formed, and an upper portion which is rotatable with respect to the lower portion and threadedly connected to the body.

18. A seal assembly, comprising a body adapted to be lowered into a landed position within the bore of a well member, said body having an outer cylindrical side adapted to fit closely within the bore, and a shoulder extending inwardly from its outer side, and a cylindrical surface extending above the shoulder, an expander sleeve vertically slidable over the cylindrical surface of the body and having a cylindrical surface thereabout, both of said cylindrical surfaces being concentric with the outer side of said body, means sealing between the sleeve and the cylindrical surface of the body, a seal ring of elastomeric material having an inner diameter which fits closely about the cylindrical surface of the body for seating on said body shoulder, another sleeve surrounding the cylindrical surface of the expander sleeve and having a shoulder on its lower end and an outer cylindrical surface which is substantially aligned with the outer side of said body, means connecting the other sleeve to the expander sleeve, means connecting the expander sleeve to the body with the lower ends of said sleeves close to the upper end of the seated seal ring, the outer diameter of the seal ring being no greater than that of said shoulders, each of said connecting means being releasable to permit said expander sleeve to move downwardly with respect to said body and said other sleeve, so as to stretch said seal ring into a position in which its inner diameter is sealably engaged about the cylindrical surface of the expander sleeve, and its outer diameter protrudes from the outer cylindrical side of said body and the outer cylindrical surface of said other sleeve for sealably engaging the bore, means on the lower end of the expander sleeve engageable with a portion of the body shoulder to limit downward movement of the expander sleeve, and means on the expander sleeve engageable with the other sleeve to limit upward movement of the other sleeve relative to said expander sleeve, so as to locate said shoulders in positions in which they are spaced from one another a distance not substasntially greater than that of the end-to-end spacing of the stretched seal ring.

19. A seal assembly of the character defined in claim 18, wherein the shoulder of the expander sleeve includes a conical surface.

20. A seal assembly of the character defined in claim 19, wherein the portion of the body shoulder is a conical surface which conforms to the conical surface on the shoulder of the expander sleeve.

21. A seal assembly of the character defined in claim 18, including latch means on the body engageable with the expander sleeve to limit upward movement of the expander sleeve substantially beyond the position from which it is moved downwardly.

22. A seal assembly of the character defined in claim 18, wherein the expander sleeve includes a lower portion over which the seal ring is stretched, and an upper portion which is rotatable with respect to the lower portion and threadedly connected to the body.

* * * * *